US009943743B1

(12) United States Patent
Diley

(10) Patent No.: US 9,943,743 B1
(45) Date of Patent: Apr. 17, 2018

(54) CORE PUTTING STROKE TRAINER

(71) Applicant: Mark J. Diley, Boyds, MD (US)

(72) Inventor: Mark J. Diley, Boyds, MD (US)

( * ) Notice: Subject to any disclaimer, the term of this patent is extended or adjusted under 35 U.S.C. 154(b) by 0 days.

(21) Appl. No.: 15/469,471

(22) Filed: Mar. 24, 2017

(51) Int. Cl.
*A63B 69/36* (2006.01)

(52) U.S. Cl.
CPC .. *A63B 69/3685* (2013.01); *A63B 2208/0204* (2013.01)

(58) Field of Classification Search
USPC ..... 473/205, 207, 215, 219, 226, 227, 266, 473/277
See application file for complete search history.

(56) References Cited

U.S. PATENT DOCUMENTS 5,156,401 A * 10/1992 Hodgkiss ..... A63B 69/3632 473/227
5,397,121 A * 3/1995 Gipson ..... A63B 69/3608 273/DIG. 30
5,658,203 A * 8/1997 Shub ..... A63B 69/0059 473/205
7,033,284 B2 * 4/2006 Yoshimura ..... A63B 69/3608 473/212
7,942,755 B2 * 5/2011 Diley ..... A63B 69/3608 473/215

* cited by examiner

*Primary Examiner* — Nini Legesse
(74) *Attorney, Agent, or Firm* — N. J. Aquilino

(57) ABSTRACT

A putting trainer that teaches a golfer to practice a repetitive putting stroke while maintaining the golfer's hands and arms connected to the golfer's core torso body portion. The trainer teaches the golfer to eliminate excessive use of the hands and arms by synchronizing the movement of the putter with the golfer's spine and core body structure. The trainer uses a core attached yoke, a connector coupling the yoke to a putter and a visual indicator for the golfer to determine the relationship of the putter to the golfer's core.

11 Claims, 5 Drawing Sheets

CORE PUTTING STROKE TRAINER

RELATED APPLICATIONS

The current application relies on the disclosure of Provisional Application No. 62/313,308 filed Mar. 25, 2016 titled CORE PUTTING TRAINER

BACKGROUND OF THE INVENTION

The present invention is a golf putting trainer designed to improve a golfer's putting stroke.

A preferable method of executing a putting stroke to minimize miss hits and inconsistencies has been found to eliminate excess movement of the golfer's hands while emphasizing movement of the golfer's larger muscles including the shoulders and torso. There are many potential points of failure during a putting stroke including the arms that should not push or pull during the stroke and the forearms that should not rotate. The wrist joints should not supply power to the putting stroke and should not move or hinge during the stroke.

A number of training devices have been developed for this purpose including applicant's own U.S. Pat. No. 7,942,755 for a Core Connector Putting Stroke Trainer. The object of this patent is to train a golfer to move the torso with the hands and putter. The trainer includes a torso engaging, parabolic shaped yoke and an adjustable length connector to attach the torso engaging yoke to the golfer's putter. The connector is adjustable in length only and is clamped to the upper edge of the putter grip when used to practice the putting stroke.

Other patented putting practice devices and apparatus are shown in US patents to Yuhara U.S. Pat. No. 4,509,757, Stawicki U.S. Pat. No. 5,150,901, Hodgkiss U.S. Pat. No. 5,156,401, Hirsch U.S. Pat. No. 5,413,329, Scheie et al U.S. Pat. No. 5,531,446, Moran U.S. Pat. No. 6,358,156 and Flood U.S. Pat. No. 7,033,282, among others.

SUMMARY OF THE INVENTION

The present invention is directed to an improvement of the core connector putting stroke trainer disclosed in my previous U.S. Pat. No. 7,942,755.

Like the patented trainer, the present invention, when properly engaged, defeats the golfer's tendency to use the hands and wrists in the putting stroke. The trainer engages the body at an area just below the breastbone connected to the upper part of the ribcage. The ribs are directly connected to the spine that moves the shoulders, arms, and hands that in turn hold the putter. When the spine is engaged, the other parts of the body move together thereby eliminating excessive movement of the putter by the hands and/or arms. Thus the trainer of the present invention teaches a golfer to use the larger parts of the body, particularly the spine, to move the putter in a smooth, deliberate manner resulting in a more efficient putting stroke.

The trainer includes a yoke member having an inner arcuate shaped, body engaging edge with three tactile anchors that extends across the golfer's torso below the breastbone at the upper rib area to maintain the trainer in position during the execution of a practice putting stroke. A two-piece connector rod connects the yoke to the putter. An upper section of the connector rod is attached to the bottom of the yoke. A lower section of the connector rod adjustably fits into and is telescopically attached to the upper section. A set screw engages a flat section of the lower section and secures the two telescoping parts of the connector rod together preventing movement between the upper and lower parts of the rod. The two sections of the rod are secured at a selected length to match the physical characteristics of the golfer using the trainer. The lower area of the connector rod includes a ball connector and golf grip attachment that connects to an upper grip portion of the putter P.

The upper section of the connector rod is bent at 45 degrees to create a rotational leverage point as it joins into the yoke allowing the trainer to match the golfer's spine angle and height.

A novel feature of the trainer is a visual feedback dial that gives the golfer live feedback as it senses the sweeping motion of the putter shaft relative to the movement of the center of the golfer's body. The upper end of the connector rod is attached to the rotatable dial and rotatably fits into a complimentary ring formed by the bottom of the yoke. The dial includes a visual indicator that can be seen by the golfer when using the trainer to practice the putting stroke. The dial and ring include a latch member that allows movement between the dial and ring in an open position and prevents movement between the dial and ring in a closed position.

The visual indicator on the dial includes a pointer and three indicator targets. The center target represents that the putter is moving together with the yoke and the golfers body the yoke is attached to. Targets on either side of the center target indicate that the putter is either moving ahead of the yoke and golfer's body or that the putter is lagging behind the yoke and golfer's body. In the open, un-latched position of the latch, the dial pointer is free to rotate as the putter moves through a putting stroke.

The feedback dial may be used in an open or locked position using a latch member that is slidably connected to a slot in the ring at the end of the yoke. In the open position, the latch is removed from the slot and the dial is free to rotate and mirrors the putter shaft motion relative to the golfer's torso. In this position the golfer is challenged to integrate the arm and putter swing motion or lag to return the pointer back the starting position at the central target at impact with a golf ball. In the unlatched position, typically there is a separation of the putter and arms at the end of the backswing. With the dial unlatched, the trainer is particularly useful for putts over eight feet and longer.

In the latched position, the latch is engaged in the slot and the pointer is locked and not free to move. In this mode the golfer is challenged to move all parts of the body including the center, the arms and wrists as well as the putter itself in unison while keeping the trainer connected to the torso. This position is particularly useful for putts of eight feet or less.

The trainer of the present invention allows a golfer to focus on one area of the body only to maximize creating consistency in the putting stroke.

Among the objects of the present invention is the provision of a putting trainer that teaches a golfer to rotate the torso during the execution of a putting stroke.

Another object is the provision of a putting trainer that provides a tactile indication that the trainer is being properly used.

Still another object is the provision of a putting trainer that includes a visual feedback indicator of the use of the trainer.

These and other objects will become apparent with reference to the following specification and accompanying drawings.

DESCRIPTION OF A PREFERRED EMBODIMENT

The putting trainer apparatus of the present invention teaches a golfer to practice a repetitive putting stroke while maintaining the golfer's hands and arms connected to the golfer's core torso body portion. The trainer teaches the golfer to eliminate excessive use of the hands and arms by synchronizing the movement of the putter with the golfer's spine and core body structure.

Figure 1:
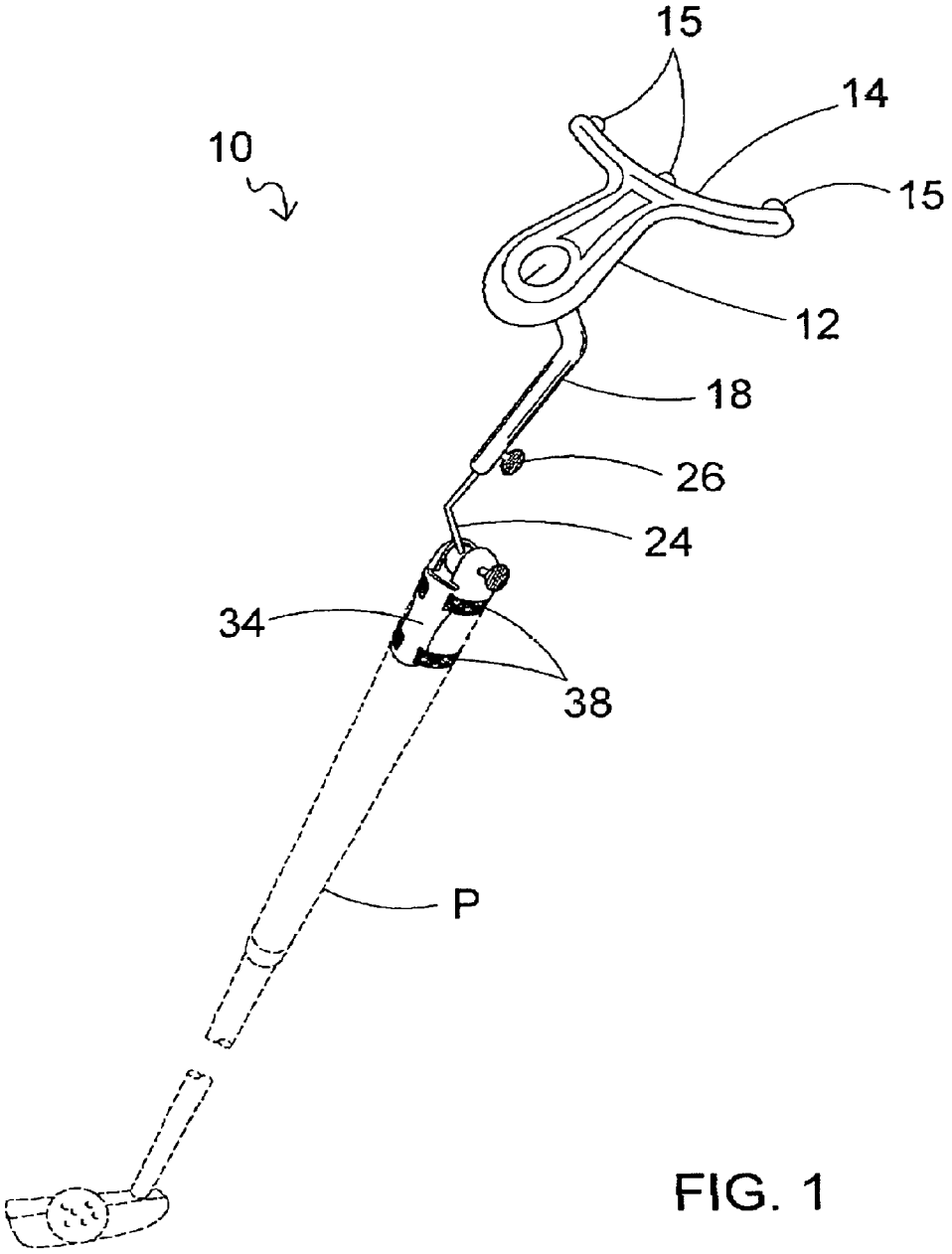
FIG. 1 shows a golf training apparatus of the present invention attached to a conventional golf putter.

Referring to the drawings, a preferred embodiment of the putting trainer 10 is illustrated in FIG. 1 attached to a golf putter P. The trainer 10 includes a yoke member 12 having an inner arcuate shaped, torso engaging edge 14 that is designed to fit the curve of the torso of the human body and extends across the golfer's torso at the abdominal area to maintain the trainer 10 in position during the execution of a putting stroke.

The yoke member 12 has three tactile sensors 15 in the form of torso engaging studs on the torso engaging edge 14 that engage the golfer using the trainer 10. The center sensor 15 is designed for placement at the sternum area of the golfer's body between the ribs. Once the center sensor 15 is placed at the sternum, the golfer pulls the trainer 10 into the torso and feels pressure from all the sensors 15. Ideally this pressure is maintained during a putting stroke using the trainer 10. The two outer sensors 15 stabilize the yoke member 12 against the golfer's body during practice with the trainer 10.

Figure 2:
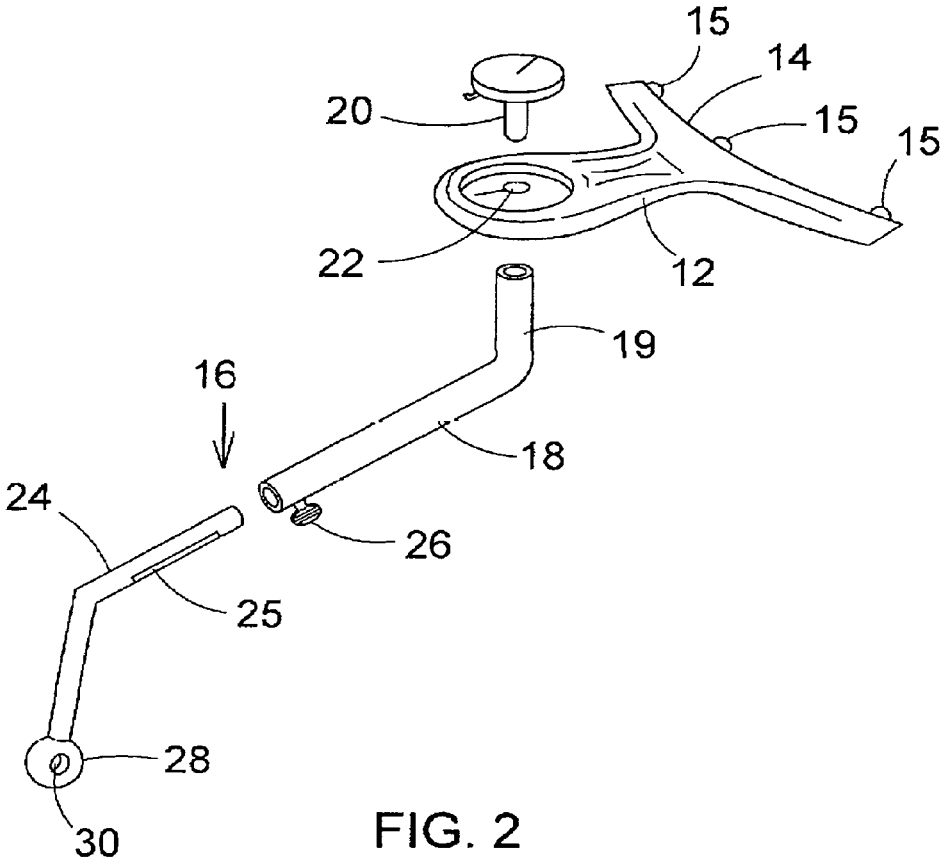
FIG. 2 shows a partial, exploded view of the golf training apparatus of FIG. 1.

As illustrated in FIG. 2, a two-piece connector rod 16 has an upper section 18 having a first diameter that is attached to the bottom of the yoke 12 by a threaded, plastic bolt 20 that extends through a bore 22 at the lower portion of the yoke 12. The upper end 19 of the upper sectionl8 is bent at an angle that creates a rotational leverage point as it joins into the yoke 12. The connector rod 16 includes a lower section 24, having smaller diameter than the diameter of the upper section 18 and telescopically fits into the upper section 18. The lower section 24 includes a flat, screw engaging surface 25 that is engaged by a set screw 26 to secure the lower section 24 of the connector rod 16 at an adjustably selected, non-rotatable position to accommodate the physical characteristics of the golfer using the trainer 10. The flat, screw engaging surface 25 insures that the lower section 24 does not rotate relative to the upper section 18 during practice with the trainer 10.

Figure 3:
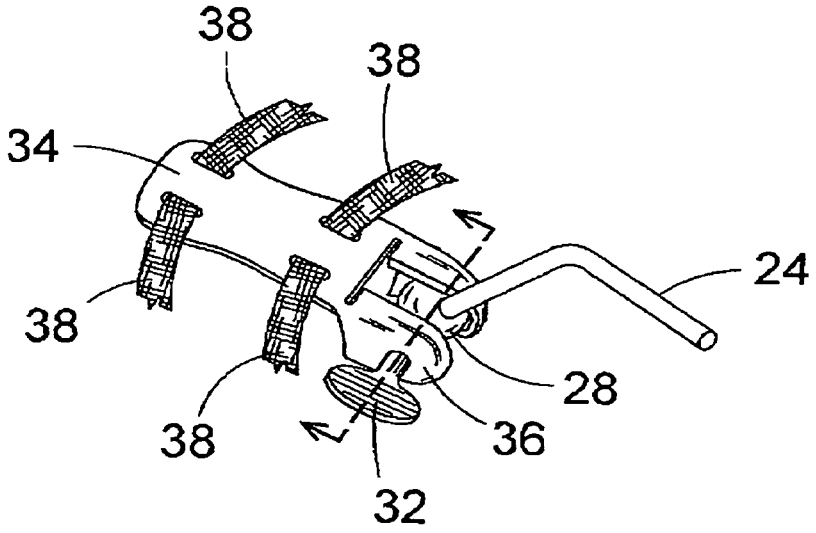
FIG. 3 shows a detail of the apparatus of FIG. 1.
Figure 4:
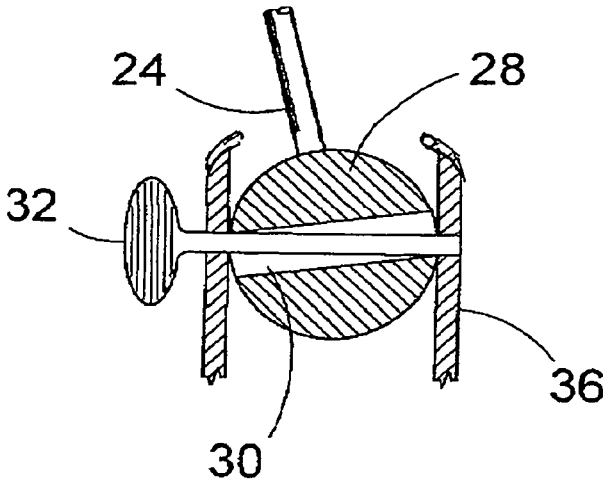
FIG. 4 shows a detail of FIG. 3.
Figure 5:
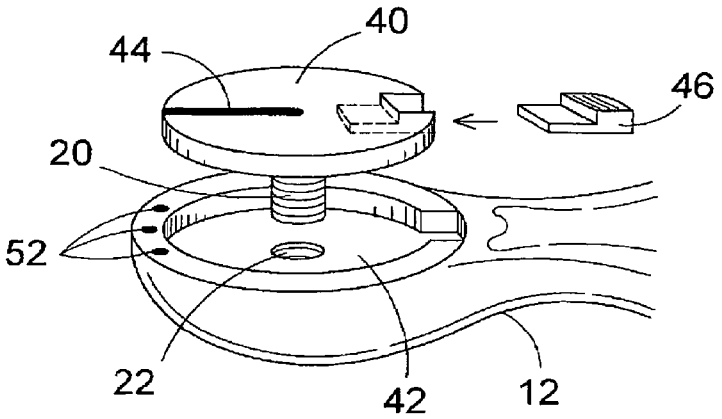
FIG. 5 shows an exploded view of another detail of the present invention.

Referring to FIGS. 3 and 4, the lower section 24 of the connector rod 16 includes a ball 28 with a central bore 30 that accommodates a smaller diameter thumb screw 32. A grip attachment 34 includes a cup-shaped upper end 36 forming a socket that accommodates the ball 28 at the end of the connector rod 16. Separable fastener straps 38 are provided for attachment to the upper grip portion of the putter P.

Figure 6:
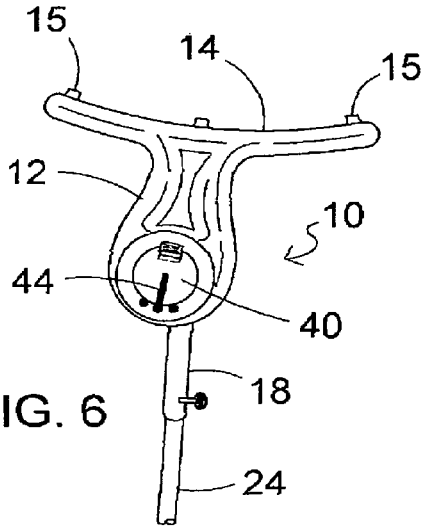
FIG. 6 shows the upper section of the apparatus in a first adjusted position.
Figure 7:
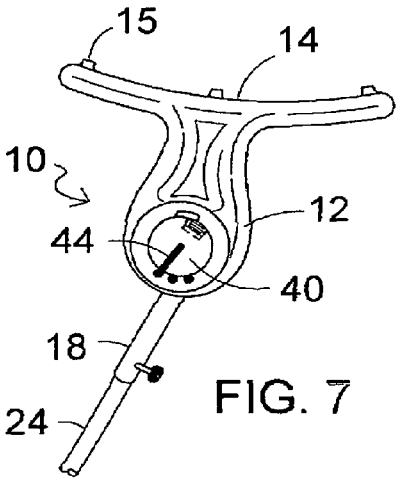
FIG. 7 shows the upper section of the apparatus in a second adjusted position.
Figure 8:
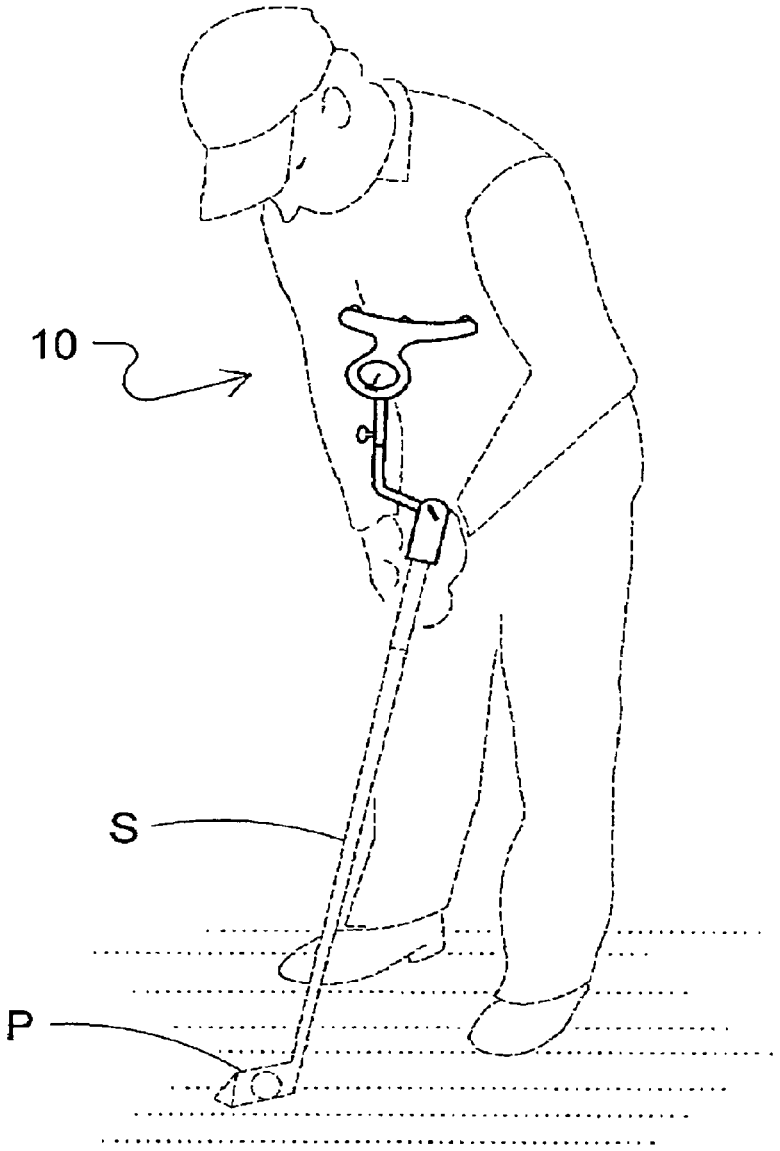
FIG. 8 is a perspective view of the apparatus attached to a putter showing its use by a golfer shown in phantom lines.

A visual feedback dial 40 on an upper surface of of the yoke member 12 gives the golfer live feedback as it senses the sweeping motion of the putter shaft S relative to the movement of the center of the golfer's body. The upper end 19 of the connector rod 16 is attached to the rotatable dial 40 and rotatably fits into a complimentary ring 42 formed by the bottom of the yoke member 12. The dial 40 includes a visual pointer 44 that can be seen by the golfer when using the trainer 10 to practice the putting stroke. The dial 40 and ring 42 assembly includes a latch member 46 that engages a slot 48 on the ring 42 when in a locked position to prevent movement between the dial 40 and ring 42 as seen in FIG. 6. When the latch member 46 is disengaged from the slot 48 in an open position this allows movement between the dial 40 and ring 42 as seen in FIG. 7.

The visual pointer 44 on the dial 40 cooperates with three targets 52. The center target 52 represents that the putter is moving together with the yoke and the golfers body the yoke 12 is attached to. Targets 52 on either side of the center target indicate that the putter is either moving ahead of the yoke 12 and golfer's body or that the putter is lagging behind the yoke 12 and golfer's body. In the open position of the latch 46, the visual pointer 44 is free to rotate as the putter P moves through a putting stroke.

In one position, the latch 46 is engaged with the slot 48 and the dial 40 rotates with the yoke 14 and mirrors the putter shaft motion relative to the golfer's torso. In this position the golfer is challenged to integrate the arm and putter swing motion or lag to return the pointer 44 back the starting position at the central target 52 during impact with a golf ball. In the unlocked position when the latch 46 is disengaged from the slot 48 and there is rotation between the yoke member 12 and the connector 16 attached to the putter P. With the dial unlocked the trainer 10 is particularly useful for putts over eight feet and longer where typically there is a separation of the putter and arms at the end of the backswing.

It will be appreciated that various alterations and modifications may be made in keeping with the spirit and scope of the present invention as defined in the following claims.

The invention claimed is:

1. A putting trainer apparatus in combination with a golf putter to train a golfer to keep a core portion of a golfer's body in a same position relative to the golf putter during the execution of a putting stroke; the trainer apparatus having a yoke member having an arcuate shaped, inner edge fitted to and for engaging a lower area of the core portion of the golfer body; and, a connector having an upper section connected to said yoke and a lower section connected to a handle of said golf putter; wherein an improvement comprises:

a visual feedback indicator supported on said yoke and operably connected to said golf putter wherein said indicator is attached to and movable with said connector to indicate a position of the golf putter relative to the core portion of the golfer during the putting stroke;

said visual feedback indicator having a movable display member and three indicator target positions; the three indicator target positions including a first position indicating the putter is moving faster than the core portion of the golfer; a second indicator position indicating the putter is moving slower than the core portion of the golfer and a third, mid-indicating position indicating the putter and the core portion of the golfer are moving together; wherein the position of the putter during a putting stroke is displayed on said visual feedback indicator.

2. The putting trainer apparatus of claim 1 further including a latch member to lock and maintain said visual feedback indicator in said mid-indicating position.

3. The putting trainer apparatus of claim 1 wherein said visual feedback indicator includes a movable dial and a display pointer on an upper surface of said yoke member and a series of indicator targets.

4. The putting trainer apparatus of claim 1 further including a series of tactile sensors connected to, and equally spaced on said arcuate shaped, inner edge of said yoke member for engaging the core portion of the golfer; wherein said tactile sensors are further defined as core engaging studs extending outwardly from said arcuate shaped, inner edge of said yoke member; at least one of said studs being aligned with a center of the core portion of the golfer.

5. The putting trainer apparatus of claim 1 wherein said connector is further defined as including a ball shaped member at a lower end of said lower section of said connector; and, an attachment member connected to the handle of the putter; said handle attachment member including a socket to accommodate said ball shaped member for connection therewith, whereby said ball shaped member is universally, adjustably movable within said socket to accommodate golfers of different body structures.

6. The putting trainer of claim 5 further including straps on said handle attachment member for strapping said handle attachment member to said handle.

7. A putting trainer apparatus in combination with a golf putter to train a golfer to keep a core portion of a golfer's body in a same relative position to the golf putter during the execution of a putting stroke; the trainer apparatus including a yoke member having an arcuate shaped, inner edge fitted to and for engaging a lower area of the core portion of the golfer body; and, a connector having an upper section and lower section fixed together; said upper section connected to said yoke; and a lower section connected to a handle of said golf putter; wherein an improvement comprises: a visual feedback indicator including fixed indicator targets and a movable dial and display pointer supported on said yoke; said movable dial and display pointer of said indicator being operably connected to said golf putter wherein said dial of said indicator is attached to and movable with said upper section of said connector; said fixed indicator targets including a first target at a first position indicating the putter is moving faster than the core portion of the golfer; a second target indicating the putter is moving slower than the core portion of the golfer and, a third, target position indicating the putter and the core portion of the golfer are moving together; whereby the position of the putter relative to the core portion of the golfer during a stroke is displayed on said visual feedback indicator.

8. The trainer apparatus of claim 7 further including a second feedback indicator comprising a series of core engaging studs extending outwardly from said arcuate shaped, inner edge of said yoke member and being aligned with a center of the core portion of the golfer.

9. A putting trainer apparatus in combination with a golf putter to train a golfer to keep a core portion of a golfer's body in a same relative position to the golf putter during the execution of a putting stroke; the trainer apparatus including; an indicator to display a position of the golf putter; means connecting said indicator at the core portion of said golfer; said indicator including at least one movable display member; and, a connector having an upper section attached to said movable display member; said connector having a lower section connected to a handle of said golf putter; whereby a movement of the putter relative to the golfer's body during a putting stroke moves said movable display member to provide a display on said indicator of the position of the putter relative to the golfer.

10. The putting trainer apparatus of claim 9 further including a yoke member positioned at the golfer's core portion;

said yoke member forming a support for said indicator said yoke member including a plurality of display member targets that cooperate with said movable display member.

11. The putting trainer of claim 10 further including a latch to maintain the movable display member in a fixed position relative to said yoke member support.

* * * * *